United States Patent [19]

Kuroyanagi et al.

[11] Patent Number: 4,601,641

[45] Date of Patent: Jul. 22, 1986

[54] DISCHARGE PRESSURE-DEPENDANT VARIABLE-CAPACITY RADIAL PLUNGER PUMP

[75] Inventors: Masatoshi Kuroyanagi; Masahiko Suzuki; Hiroshi Iwata, all of Aichi, Japan

[73] Assignee: Nippondenso Co. Ltd., Kariya, Japan

[21] Appl. No.: 758,383

[22] Filed: Jul. 24, 1985

[30] Foreign Application Priority Data

Jul. 24, 1984 [JP] Japan ..... 59-154296

[51] Int. Cl.[4] ..... F04B 49/06; F04B 49/08

[52] U.S. Cl. ..... 417/220

[58] Field of Search ..... 417/220, 218, 222

[56] References Cited

U.S. PATENT DOCUMENTS

| | | | |
|---|---|---|---|
| 3,067,693 | 12/1962 | Lambeck | 417/219 |
| 4,375,942 | 3/1983 | Olson | 417/222 |
| 4,496,290 | 1/1985 | Nonnennachen | 417/220 |

*Primary Examiner*—Richard E. Gluck

*Attorney, Agent, or Firm*—Cushman, Darby & Cushman

[57] ABSTRACT

The radial plunger pump has a rotor in which a plurality of plungers are radially slidingly received and have their outer ends in engagement with a guide ring which is provided so as to be eccentric from the rotor, so that the plungers reciprocate in their cylinders as the rotor rotates. The eccentric amount is controlled by the movement of a controlling piston, and the movement of the controlling piston is controlled by a pilot valve. The pilot valve which has a sleeve and a shaft member, switches the pressure in a chamber formed behind the controlling piston in order to control the movement of the controlling piston. The position of the shaft member of the pilot valve is further controlled by an electrical control, so that the critical point at which the pilot valve switches the pressure is controlled by the electrical control.

3 Claims, 6 Drawing Figures

DISCHARGE PRESSURE-DEPENDANT VARIABLE-CAPACITY RADIAL PLUNGER PUMP

FIELD OF THE INVENTION

The present invention relates to a variable-capacity pump and especially to a variable-capacity radial plunger pump the discharge amount of which is varied in accordance with the discharge pressure. The pump of the present invention can be used as a power source of a powered device of an automobile or for a fuel pump of an automobile.

BACKGROUND OF THE INVENTION

Conventionally, a pump used as a power source of a powered device has a relief valve in order to prevent an extraordinary increase of discharge presure. When the discharge presure of the pump reaches a predetermined presure, the relief valve opens a relief path so that discharged fuel can flow through the relief path toward the suction portion of the pump.

It has been also suggested to use variable-capacity pumps in order to prevent an extraordinarily high pressure. However, these conventional variable-capacity pumps vary their capacity in accordance with the rotation speed of the pump or the amount of discharged fluid. No variable capacity pump which varies its capacity in accordance with the discharge presure has heretofore been developed, to the present inventors' knowledge.

SUMMARY OF THE INVENTION

An object of the present invention is to provide a variable-capacity radial plunger pump which can control the amount of fluid discharged in accordance with the discharge pressure thereof, so that the pump can reduce its capacity when the discharge pressure exceeds a predetermined point.

A further object of the present invention is to provide a way of changing that predetermined point in order to control the character of the pump more comprehensively.

In order to attain the above-described objective, the pump of the present invention employs a pilot valve which controls an eccentric amount betweeen a grid ring and a rotor in order to control the discharge amount. The pump of the present invention also employs an electrical controlling means which controls the position of a shaft member of the pilot valve in order to change the predetermined pressure point from which the pump reduces its capacity.

DETAIL DESCRIPTION

Figure 1:
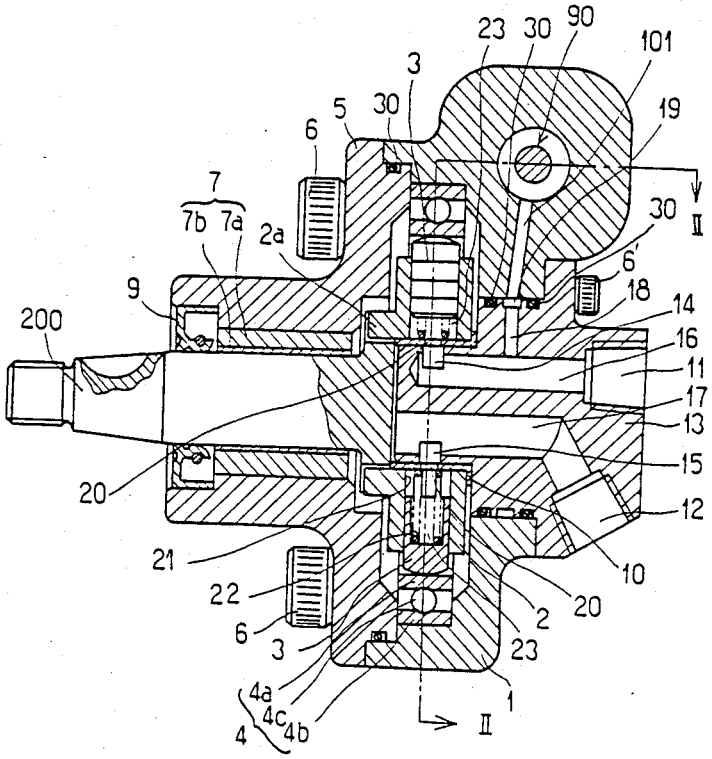
FIG. 1 is a logitudinal sectional view of a plunger pump embodying principles of the present invention.
Figure 2:
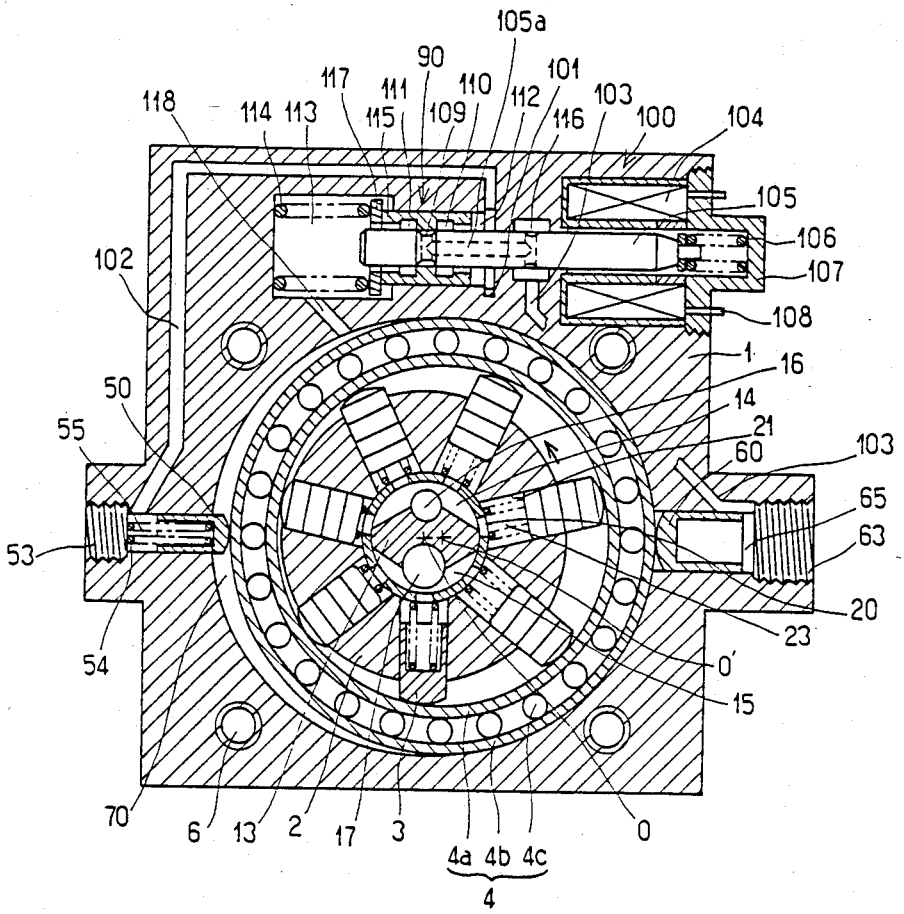
FIG. 2 is a transverse sectional view of the pump taken along line II—II of FIG. 1.
Figure 3:
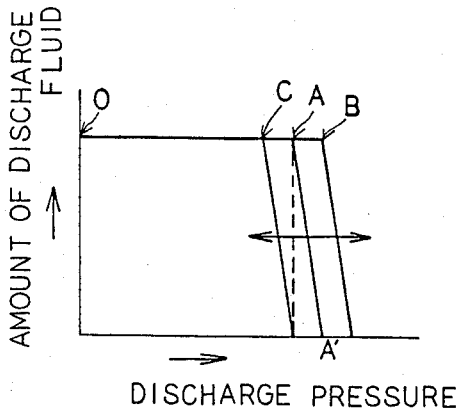
FIG. 3 is a chart showing the relationship between discharge pressure and amount of discharge fluid of the pump shown in FIG. 1.

The first embodiment of the present invention is explained using FIGS. 1, 2, and 3. Numeral 1 indicates a housing which forms outer shape of a pump. Numeral 2 indicates a rotor which is supported inside the housing 1 and is adapted to be rotated by a power source. Seven radial cylinders 21 are shown provided in rotor 2. Each cylinder 21 receives a plunger 3 therein in such manner that such plunger 3 can slide along the longitudinal axis of the respective cylinder 21. Each plunger 3 is pressed outwardly by respective spring 22 which is held in the respective cylinder 21. The radially outer end of each plunger 3 is part-spherically shaped. The radially inner end of each plunger 3 and the inside of each cylinder 21 together define respective pump chambers 23.

Numeral 200 shows a drive shaft which is arranged to be driven by an engine or a motor (not shown). Since rotor 2 is fixed with drive shaft 200 by connecting part 2*a* therof, rotor 2 can rotate with drive shaft 200. Numeral 5 indicates a side-housing which is fixed with respect to the housing 1 by a bolt 6. Numeral 7 indicates a journal bearing made of support ring 7*a* which is inserted in side-housing 5 and a sliding ring 7*b* which is inserted in the support ring 7*a*. Journal bearing 7 supports rotation of drive shaft 200. Numeral 9 indicates an oil seal which prevents oil inside of housing 1 from leaking through the outer surface of the drive shaft 200.

Numeral 10 indicates a bushing which is made of phosphor copper and is fixed with the inner surface of the rotor 2 so that bushing 10 can rotate against the rotor 2. Bushing 10 is provided on pintle 13 in such a manner that bushing 10 can rotate. Connecting ports 20, the number of which is the same as that for cylinders 21, are punched in bushing 10 at positions such that each connecting port 20 faces a respective cylinder 21. The diameter of each connecting port 20 is smaller than that of the respective cylinder 21 so that the inner ends of the associated springs 22 are supported by the bushing 10. A discharge groove 14 is provided at the discharge side of pintle 13 and a suction groove 15 is provided at the suction side of the pintle 13 as is shown in FIG. 2. When the rotor 2 has rotated to an extent such that a particular plunger 3 is located in the discharge side of the pump, i.e., in the upper side in FIG. 2, the respective pump chamber 23 connects with the respective discharge port 11 through the respective connecting port 20, discharge groove 14 and discharge path 16. When, due to rotation of the rotor 2, that plunger 3 becomes located in the suction side, i.e. in the lower side of FIG. 2, the respective pump chamber 23 connects with the respective suction port 12 through the respective port 20, suction groove 15 and suction path 17. An annular groove 19 is provided on the outer surface of pintle 13; the annular groove 19 is connected with the discharge path via connecting a path 18. Pintle 13 is fixed with respect to the housing 1 by a bolt 6.

A guide ring 4, which is made of an inner ring 4*a*, outer ring 4*b* and steel balls 4*c*, is provided outside of the rotor 2. The inner ring 4*a* is engaged with the radially outer ends of the plungers 3 so that inner ring 4*a* rotates with almost some rotational speed as the rotor 2. On the other hand, outer ring 4*b* is engaged with the stationary inner surface of the housing 1. Letter O' designates the geometric center of guide ring 4 and letter O designates the geometric center of the rotor 2.

Numeral 50 indicates a first controlling piston which is slidably inserted in housing 1 at such a position that the top end of first controlling piston 50 engages the radially outer side of the outer ring 4*b*. A first spring 54 which is supported by a cap 53, is provided behind the first controlling piston 50 in order to push the first controlling piston 50 toward guide ring 4. The cap 53 is screwed in housing 1. A first chamber 55, defined by the first controlling piston 50, the housing 1 and the cap 53 is connected with the annular groove 19 via connecting paths 101 and 102 so that the discharge pressure is introduced into first chamber 55.

A second controlling piston 60 is also slidably mounted in housing at an opposite position from the first controlling piston 50. A second chamber 65 is defined behind the second controlling piston by the second controlling piston and the cap 63. The second chamber 65 is connected with an annular groove 116 which is provided in the housing, through a connecting path 103 which is also provided in housing 1.

Numeral 30 designates an O-ring for sealing. Numeral 115 indicates a sleeve which is provided in the path through which the discharge pressure is introduced into first chamber 55 so that the sleeve 115 can move in accordance with the discharge pressure. Numeral 90 indicates a pilot valve which is made of the sleeve 115 and the shaft member 105. The shaft member 105 is inserted into the sleeve 115 in such a manner that the sleeve 115 can slide along the longitudinal axis of shaft member 105. Pilot valve 90 can control the oil pressure in second chamber 65. A spring 114 is provided at one end of the sleeve 115 via a plate 117 in order to force the sleeve 115 rightwards in FIG. 2. The other end of sleeve 115 faces a high pressure chamber 112 which is connected with path 102. Therefore, sleeve 115 is forced leftward in FIG. 2 by the oil pressure. Sleeve 115 has two annular grooves, one is high pressure groove 110 and the other is low pressure groove 111, at inner surface thereof. High pressure groove 110 is connected with high pressure chamber 112, and low pressure groove 111 is connected with the inner space 70 of the pump through the connecting path 118 and low pressure chamber 113.

Shaft member 105 is made up of a magnetic substance so that shaft member 105 functions as the core of a linear solenoid valve 100. Linear solenoid valve 100 can control the longitudinal movement of the shaft member 105 in accordance with the electrical current supplied to terminal 108 of coil 104. Namely, when electrical current is supplied to the terminal 108, the magnetic force generated by the coil 104 causes shaft member 105 to move rightwards in FIG. 2 against the restoration force of a spring 106. Shaft member 105 has an annular groove 109 provided on the outer surface thereof. The width of the annular groove 109 is narrower than the distance between the high pressure groove 110 and the low pressure groove 111. Shaft member 105 also has a center path 105*a*, which connects the control groove 109 and the annular groove 116, at the inside thereof. The grooves 110 and 111 of sleeve 115 and the grooves 109 and 116 of shaft member 105 are switched by the movement of sleeve 115. Accordingly, pilot value 90 can switch the oil pressure in second chamber 65 between the low pressure and the discharge pressure. Since both ends of the shaft member 105 do not receive the discharge pressure, shaft member 105 can be moved by a small power such as the magnetic force of the linear solenoid valve 100.

The operation of the pump described above is explained as follows:

Since the center O of the rotor 2 is laterally displaced from the center O′ of guide ring 4, plungers 3 reciprocate while rotor 2 rotates (counterclockwise in FIG. 2) so that fluid is introduced into and discharged from pump chambers 23. During the suction stroke, the fluid is introduced into respective pump chambers 23 through suction port 12, suction path 17, respective suction groove 15 and respective connecting path 20. During the discharge stroke, the fluid in pump chamber 23 is discharged toward discharge port 11 via connecting the respective port 20, discharge groove 14 and discharge path 16.

Guide ring 4 can be moved horizontally in FIG. 2 in order to vary the capacity of the pump. When the guide ring 4 is moved leftwards in FIG. 2, the eccentric amount e between the centers O and O′ is reduced. Therefore, the reciprocal movement of plunger 3 is also reduced, so that the capacity of the pump is reduced. In order to make guide ring 4 be moved by a small force, the outer ring 4*b* is rotated when it moves. Namely, since guide ring 4 is forced upwardly in FIG. 2, outer ring 4*b* is rotated clockwise in FIG. 2 while guide ring 4 is moved rightwards in FIG. 2.

The way how to control the discharge amount in accordance with the discharge pressure is next explained. Since the first chamber 55 of the first controlling piston 50 is connected with the discharge port 16 through the connecting path 101, the high pressure chamber 112 and the connecting path 102, the oil pressure in the first chamber 55 is the discharge pressure. On the other hand, the second chamber 65 of the second controlling piston 60 is connected with the inside 70 of the pump when the discharge pressure is not high enough so that the oil pressure in the second chamber 65 is almost the same as atmospheric pressure. Accordingly, sleeve 115 of pilot valve 90 is forced rightward in FIG. 2 by spring 114 when the discharge pressure is not high enough, so that controlling groove 109 of shaft member 105 faces the low pressure groove 111 of the sleeve 115. Therefore, the second chamber 65 is contacted with the inside 70 of the pump through the connecting path 103, the pilot valve 20 (annular groove 116, center path 105*a*, controlling groove 109 and low pressure groove 111), the low pressure chamber 113, and the connecting path 118. Therefore, the oil pressure in the first chamber 55 is higher than that in the second chamber 65 while the discharge pressure is not high enough, so that guide ring 4 is located at its furthest rightward position in FIG. 2. Accordingly, the eccentric amount e is highest, and the capacity of the pump is at its maximum. These conditions are indicated by line 0A in FIG. 3.

After the discharge pressure increases sufficiently, the discharge pressure is introduced into second chamber 65. Since the oil pressure is the high pressure space 112 is the same as the discharge pressure, sleeve 115 is moved leftwards in FIG. 2 against spring 114 when the discharge pressure is higher than the set force of spring 114. Therefore, the high pressure groove 110 of sleeve 115 faces the controlling groove 109 of shaft member 105. Then, the discharge pressure in discharge port 16 is introduced into the second chamber 65 through the connecting path 103, and the pilot valve 90 (annular groove 116, center path 105*a*, controlling groove 109, high pressure groove 110 and high pressure chamber 113).

Since the effective area of the second controlling piston 60 is larger than that of the first controlling piston 50, guide ring 4 is forced by the second controlling piston 60 toward leftward in FIG. 2, so that the eccentric amount e is reduced. The capacity of the pump is reduced after the discharge pressure has increased to a predetermined pressure (shown by point A in FIG. 3). The line AA' in FIG. 3 represents the condition after the discharge pressure exceeds the predetermined point A.

As described below, the linear solenoid valve 100 can control the predetermined point. Shaft member 105 is moved rightwards in FIG. 2 in accordance with the amount of the electrical current supplied to coil 104, so that the distance between the controlling groove 109 of the shaft member 105 and the high pressure groove 110 of the sleeve 115 becomes small. Therefore, the high pressure groove 110 can contact with the controlling groove 109 even though the oil pressure in high pressure chamber 112 is lower than the predetermined pressure (point A in FIG. 3). Accordingly, the capacity of the pump can be reduced from the lower point (point C in FIG. 3) of the discharge pressure.

On the other hand, shaft member 105 is forced leftwards in FIG. 2 by spring 106 when the magnetic force of coil is small. Accordingly, high pressure groove 110 can face the controlling groove 109 after the oil pressure in high pressure chamber 112 reaches a higher point than the predetermined point (the point A in FIG. 3). Namely, at this condition, the pump can reduce its capacity after the higher point (point B in FIG. 3). As described above, the linear solenoid valve 100 can control the critical point from which the pump reduces its capacity).

Since the pump does not relieve the discharge oil when the discharge pressure is higher than the predetermined point, but reduces its capacity, the pump does not consume unnecessary energy. Though the discharge pressure is introduced into the first chamber 55 in the above described embodiment, the discharge pressure does not have to be introduced if the set force of the spring 54 is strong enough to keep guide ring 4 (guide ring 4 is forced leftwards in FIG. 2 by the rotation of rotor 2) and weaker than the forcing power of the second controlling piston 60.

Figure 4:
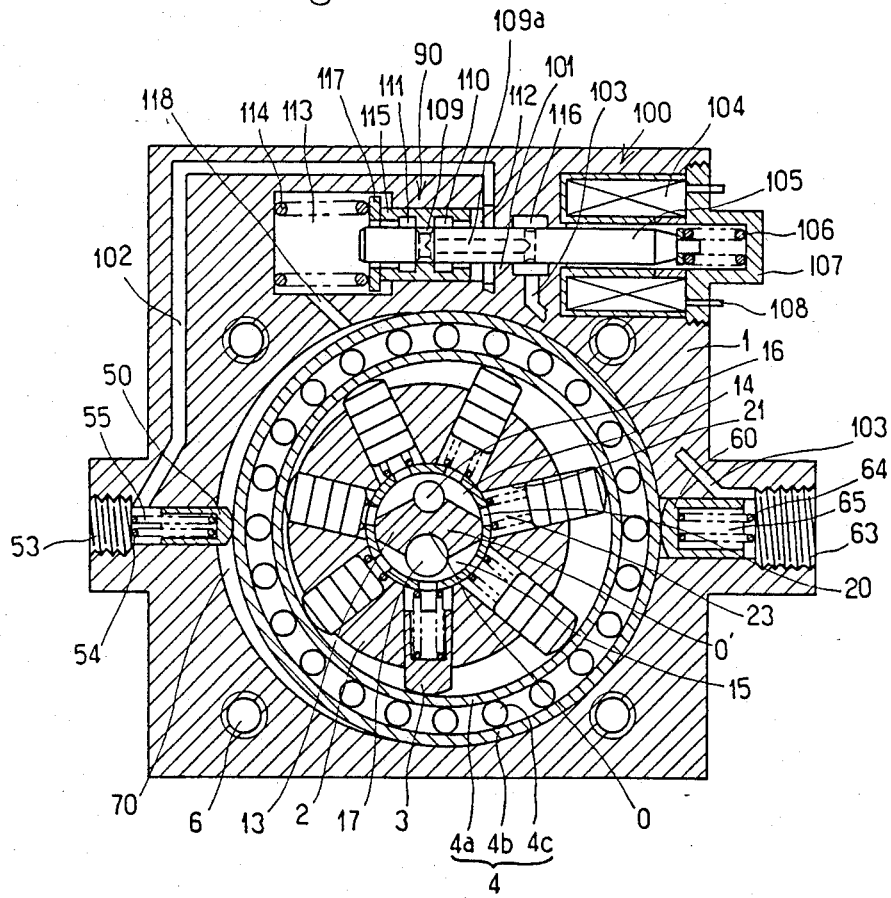
FIG. 4 is a transverse sectional view of another embodiment of the pump of the present invention.
Figure 5:
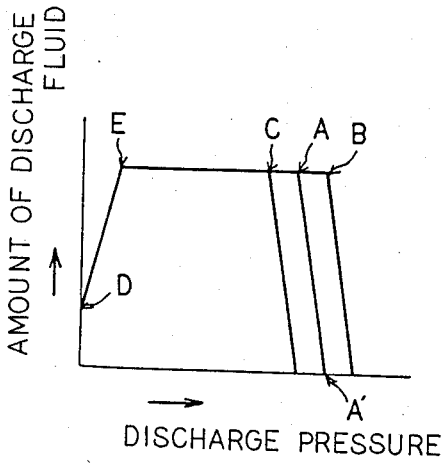
FIG. 5 is a chart showing the relationship between discharge pressure and amount of discharge fluid of the pump shown in FIG. 4.

A second spring 64 can be provided in the second chamber 65 as shown in FIG. 4. The forces of first spring 54 and second spring 64 are set in such a manner that the eccentric amount e is about $\frac{1}{3}$–$\frac{1}{2}$ of the maximum eccentric amount Cmax when rotor 2 does not rotate. Accordingly, when the pump starts to work, the eccentric amount e of guide ring 4 is $\frac{1}{3}$-Cmax$\sim\frac{1}{2}$-Cmax, so that the discharge amount of the pump is $\frac{1}{3}$–$\frac{1}{2}$ of the maximum discharge amount as shown in FIG. 5. After the pump operates, the oil pressure in first chamber 55 is increased so that first controlling piston 50 forces guide ring 4 to move rightwards in FIG. 4. These conditions are indicated by line DE in FIG. 5.

Figure 6:
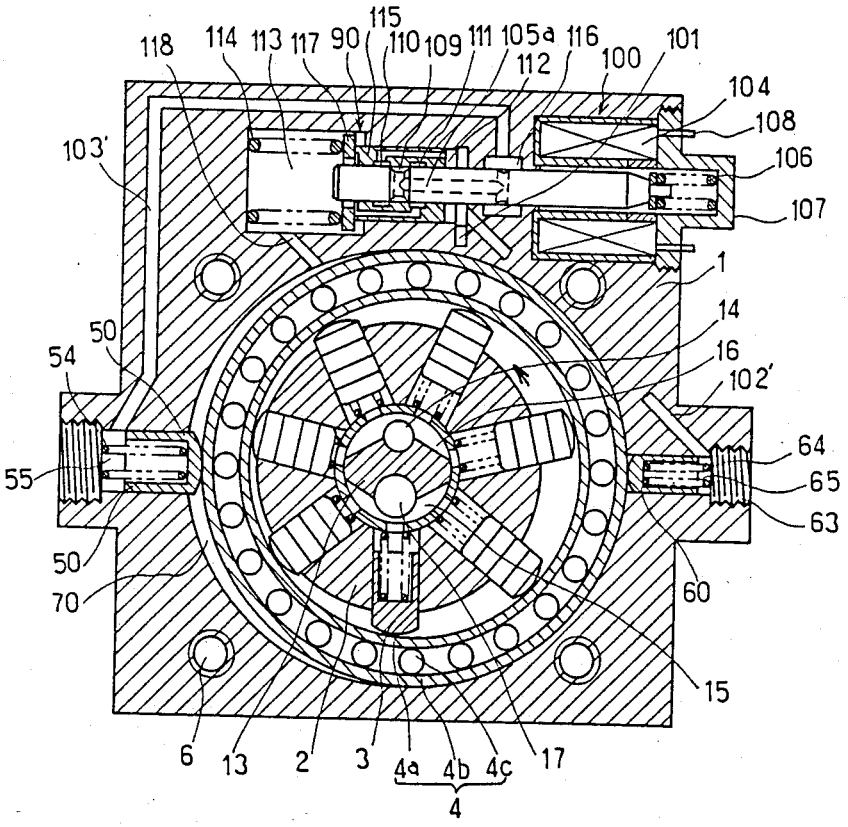
FIG. 6 is a transverse sectional view of the another embodiment of the present pump.

FIG. 6 shows another embodiment of the pump. High pressure groove 110 of this embodiment is provided at the left side of low pressure groove 111 in FIG. 6. Second chamber 65 is always connected with high pressure chamber 112 via a connecting path 102' in order to maintain the oil pressure in the second chamber 65 at the same level as the discharge pressure. First chamber 55 is connected with annular groove 116 via a connecting path 103' in order to switch the oil pressure in first chamber 55 in accordance with the movement of sleeve 115 of pilot valve 90. The effective area of the second controlling piston 60 is smaller than that of first controlling piston 50.

Since high pressure groove 110 of sleeve 115 faces the controlling groove 109 of the shaft 105 while the discharge pressure of the pump is not high enough, the discharge pressure is introduced into both first chamber 55 and second chamber 65. Accordingly, guide ring 4 is forced rightwards in FIG. 6 by first controlling piston 50 against the opposing force provided by the second controlling piston 60.

After the discharge pressure reaches the predetermined point, sleeve 115 is moved leftwards in FIG. 6 by the oil pressure in the high pressure chamber 112, so that the controlling groove 109 of shaft member 105 is disconnected from the high pressure groove 110 and is connected with the low pressure groove 111. Since the first chamber 55 is then connected with the low pressure chamber 113 via the pilot valve 90, the oil pressure in first chamber 55 is reduced. Accordingly, guide ring 4 is moved leftwards in FIG. 6 by the second controlling piston 60 in order to reduce the eccentric amount, namely to reduce the capacity of the pump.

When the electrical current supplied into linear solenoid valve 100 is increased, shaft member 105 is moved rightwards in FIG. 6, so that first chamber 55 can be connected with low pressure chamber 113 via pilot valve 90 even when the discharge pressure is not increased to the predetermined point. Accordingly, the eccentric amount e of guide ring 4 and also the capacity of the pump are reduced. On the other hand, when the electrical current supplied into linear solenoid valve 100 is reduced, the pump can reduce its capacity after the discharge pressure increases to higher than the predetermined point. As described above, the pump of this embodiment is controlled by the oil pressure in first chamber 55.

Since guide ring 4 is forced leftwards in FIG. 6 by the rotation of rotor 2, guide ring 4 can be moved even if second piston 60 is taken from the pump described in relation to FIG. 6.

Shaft member 105 of pilot valve 90 can be moved by means other than a linear solenoid valve; shaft member 105 can be moved by a D.C. motor or a step motor.

What is claimed is:

1. A variable-capacity radial plunger pump comprising:

a housing having a cavity with an inner peripheral surface providing a rotor chamber;

a rotor rotatably mounted in said rotor chamber of said housing;

said rotor having a plurality of cylinders radially provided therein;

a respective plurality of plungers slidably received in respective ones of said cylinders so that each said plunger has an outer end;

a guide ring means provided between said outer ends of said plungers and said inner peripheral surface of said housing cavity;

said guide ring means having a geometric center which is eccentric in relation to the geometric center of said rotor;

a controlling piston facing said guide ring means for controlling the amount of eccentricity of said guide ring means;

a pilot valve having a sleeve provided in a fluid path which connects means defining a chamber formed behind said controlling piston and a discharge port;

a shaft member slidably connected with said sleeve;

said pilot valve being constructed and arranged for switching the pressure in said chamber formed behind said controlling piston between a low pressure and the discharge pressure of said pump;

an electrically powered controlling means arranged for moving the position of said shaft member in order to control the relationship between said shaft member and said sleeve for changing a critical point at which said pilot valve switches the pressure in said chamber formed behind said controlling piston.

2. A variable-capacity radial plunger pump comprising:

a housing having a cavity with an inner peripheral surface providing a rotor chamber;

a rotor rotatably mounted in said rotor chamber of said housing, said rotor having a plurality of cylinders radially provided therein;

a respective plurality of plungers slidably received in respective ones of said cylinders so that each plunger has an outer end;

a guide ring provided between the outer ends of said plungers and said inner surface of said housing cavity;

said guide ring having a geometric center which is eccentric in relation to the geometric center of said rotor;

a first controlling piston facing said guide ring;

a fluid path provided for introducing the discharge pressure into means providing a chamber formed behind said first controlling piston;

a second controlling piston facing said guide ring diametrically opposite said first controlling piston for controlling the amount of the eccentricity of said guide ring;

a fluid path provided for introducing a low pressure into means providing a chamber formed behind said second controlling piston;

a fluid path provided for introducing a discharge pressure into said chamber formed behind said second controlling piston;

a pilot valve having a sleeve provided in said fluid paths;

said pilot valve being constructed and arranged for switching the pressure in said second chamber formed behind said second controlling piston between a low pressure and the discharge pressure of said pump by alternately opening said fluid paths to said second chamber;

a shaft member slidably connecting with said sleeve; and an electrical controlling means for moving the position of said shaft member in order to change the critical point at which said pilot valve switches the pressure in said chamber formed behind said second controlling piston.

3. The variable capacity radial plunger pump claimed in claim 2 further comprising:

a first spring provided in a chamber formed behind said first controlling piston for forcing said first controlling piston toward said guide ring, and· said second spring provided in a chamber formed behind said second controlling piston for forcing said second controlling piston toward said guide ring;

said first and second springs having relative spring constants such that they provide a preliminary eccentric amount between said guide ring and said rotor that is $\frac{1}{3} \sim \frac{1}{2}$ of the maximum eccentric amount.

* * * * *